US006056037A

United States Patent [19]

Jonkman, Sr. et al.

[11] Patent Number: 6,056,037

[45] Date of Patent: May 2, 2000

[54] CURTAIN WALL STRUCTURE

[75] Inventors: Frank Jonkman, Sr., Bradford; Jan-Willem Gritters, Toronto, both of Canada

[73] Assignee: Frank Jonkman and Sons Ltd., Bradford, Canada

[21] Appl. No.: 09/098,493

[22] Filed: Jun. 17, 1998

[51] Int. Cl.[7] ..... E05D 15/26

[52] U.S. Cl. ..... 160/207; 160/118; 160/229.1; 160/231.2; 49/362

[58] Field of Search ..... 160/113, 118, 160/206, 207, 201, 213, 224, 228, 229–1; 49/199, 362; 296/155, 181

[56] References Cited

U.S. PATENT DOCUMENTS

| | | | |
|---|---|---|---|
| 1,254,502 | 8/1918 | Hoppie | 49/362 |
| 2,507,965 | 5/1950 | Eichner | 160/231.2 X |
| 3,326,268 | 6/1967 | Dixon | 160/231.1 |
| 4,088,172 | 5/1978 | Pollock | 160/207 X |
| 4,240,357 | 12/1980 | Phillips | 160/113 X |
| 4,637,446 | 1/1987 | McQueen et al. | 160/207 |
| 4,913,215 | 4/1990 | Demukai | 160/207 |
| 5,133,108 | 7/1992 | Esnault | 160/229.1 X |
| 5,148,850 | 9/1992 | Urbanick | 160/229.1 X |
| 5,253,451 | 10/1993 | Hormann | 49/199 X |
| 5,282,663 | 2/1994 | Horton | 160/118 X |
| 5,299,791 | 4/1994 | Schlapp | 160/118 X |
| 5,319,990 | 6/1994 | Veale et al. | 49/362 X |
| 5,363,898 | 11/1994 | Sprague | 160/207 X |
| 5,568,704 | 10/1996 | Williams et al. | 49/362 |
| 5,601,131 | 2/1997 | Morris | 160/207 |
| 5,794,677 | 8/1998 | Cohen-Ravid | 160/207 X |
| 5,816,309 | 10/1998 | Paradise | 160/206 |

*Primary Examiner*—Daniel P. Stodola
*Assistant Examiner*—Bruce A. Lev
*Attorney, Agent, or Firm*—Bereskin & Parr

[57] ABSTRACT

A folding curtain wall acts as a large door in an exterior wall of a building such as a garden centre greenhouse. The door includes upper and lower bi-fold panels which are hinged to one another about a horizontal axis. The upper panel is hinged to the wall of the building above the opening to be closed by the door. The door can be opened and closed by raising or lowering the lower panel from its bottom edge. In the open position, the panels are folded generally flat against one another in an overhead position above the opening and effectively provide an awning above the opening. In the closed position, the door panels adopt a flat configuration or an outwardly angled configuration. In the latter case, spaces at the sides of the door are closed by fixed panels that extend outwardly from the wall of the building.

17 Claims, 8 Drawing Sheets

CURTAIN WALL STRUCTURE

FIELD OF THE INVENTION

This invention relates generally to the building art and is concerned particular with a "curtain" wall structure for use as part of an external or internal wall of a building.

BACKGROUND OF THE INVENTION

The invention has been devised primarily (though not exclusively) in the context of relatively large buildings such as commercial greenhouses, for example, for use at retail garden centres. Typically, a garden centre will have a building which serves both to provide a growing environment for plants, and as retail space in which the plants are displayed to customers for sale. As such, the building may be essentially a large greenhouse, but one that can be opened up to the outside to provide good access to customers. Ideally, a side wall of the greenhouse is provided with large doors that can be opened up during the day so that the interior space within the building becomes part of the outdoors.

Traditional techniques for addressing this objective involve the use of sliding door systems or accordion doors that fold back to the sides of the door opening. Both of these expedients have a number of disadvantages. Sliding door systems require extra space within adjacent walls for storing the panels when the door is open. Also, a track or threshold is required at ground level to guide the panels. This can represent an obstruction to traffic through the door when it is open, or at least a maintenance item. Accordion doors that fold back to the sides of the opening normally do not have to be accommodated within adjacent walls, but the folded panels do obstruct at the sides of the opening.

An object of the present invention is to provide a curtain wall structure which is capable of being opened and which avoids these disadvantages of the prior art.

SUMMARY OF THE INVENTION

The invention provides a folding curtain wall structure for installation in an opening in a fixed wall in a building. The structure includes upper and lower bi-fold panels which are hinged to one another for folding about a first horizontal axis, means for mounting the upper panel on the fixed wall adjacent an upper end of the opening for hinging about a second horizontal axis parallel to the first horizontal axis, and means for moving the panels between an open position in which they are folded against one another and extend generally horizontally outwardly from the fixed wall in an overhead location, and a closed position in which the panels extend across and substantially close the opening.

In one embodiment, the panels in the closed position adopt a configuration in which they are angled outwardly with respect to one another about the first said axis. The fixed wall then includes fixed side panels that co-operate with the bi-fold panels for closing spaces at respectively opposite sides of the structure resulting from the angled configuration of the bi-fold panels.

In other words, the invention provides a folding curtain wall, essentially in the form of a bi-fold door that folds up rather than to the side, as is conventional. When the door is open, the panels are folded generally flat against one another in an overhead position. In a greenhouse or garden centre application, the folded panels can then act as an awning or shade for people entering or leaving the building, or, for example, providing additional covered space adjacent the building. Also, there is no requirement for a threshold or track at ground level.

The bi-fold panels can be designed as appropriate to fit in with the overall design of the building. Typically, where the building is a greenhouse or garden centre building, the panels will be glazed. For example, each panel may comprise a frame holding a series of individual glass panes or glazed units.

For convenience of description, the folding curtain wall of the invention will be referred to hereafter as a "door" although no limitation is to be inferred from the use of this word. For example, the folding curtain wall of the invention could be used to close openings other than those act as access openings, and in external or internal walls of a building.

Various means can be used for moving the panels between their open and closed positions. Typically, the bottom edge of the lower panel will be guided in one or more vertical tracks, for example by providing carriages at opposite sides of the bottom edge of the lower panel but run in vertical tracks at the sides of the door opening. The carriages can be raised and lowered in the tracks to open and close the door. Two specific examples of how this can be accomplished will be described later.

BRIEF DESCRIPTION OF DRAWINGS

In order that the invention may be more clearly understood, reference will now be made to the accompanying drawings which illustrate particular preferred embodiments of the invention by way of example, and in which.

DESCRIPTION OF PREFERRED EMBODIMENTS

Figure 1:
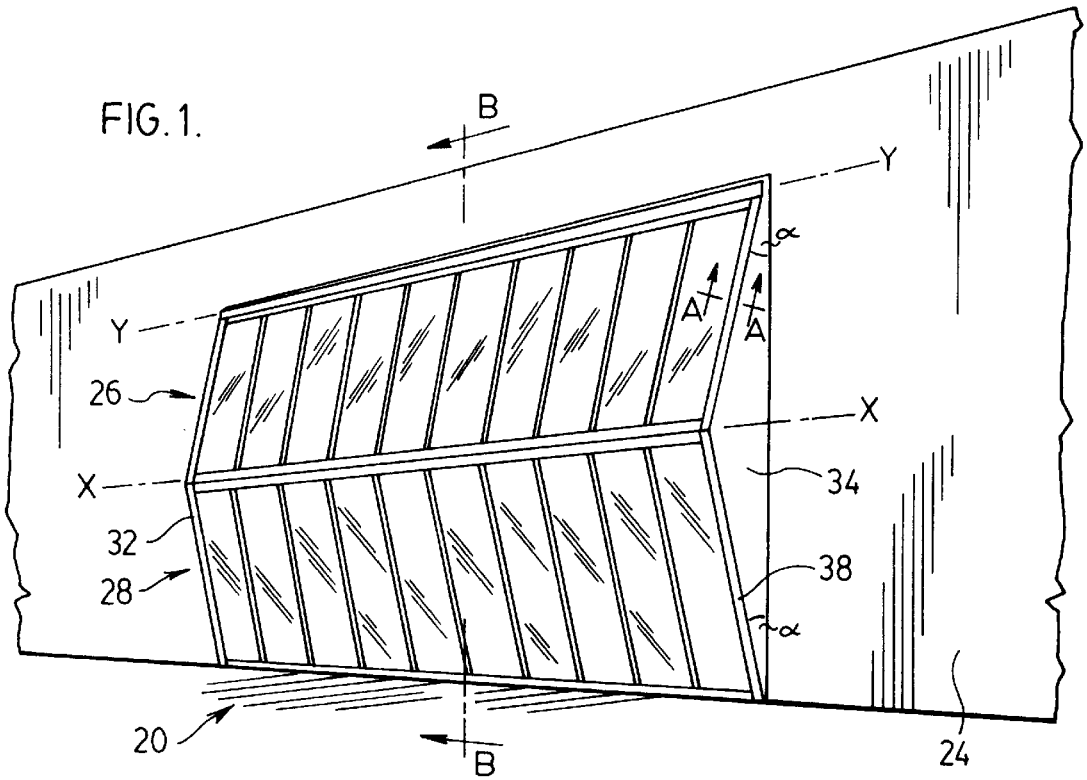
FIGS. 1 and 2 are perspective views from the outside showing a folding curtain wall in accordance with the invention in its closed and open positions respectively.
Figure 2:
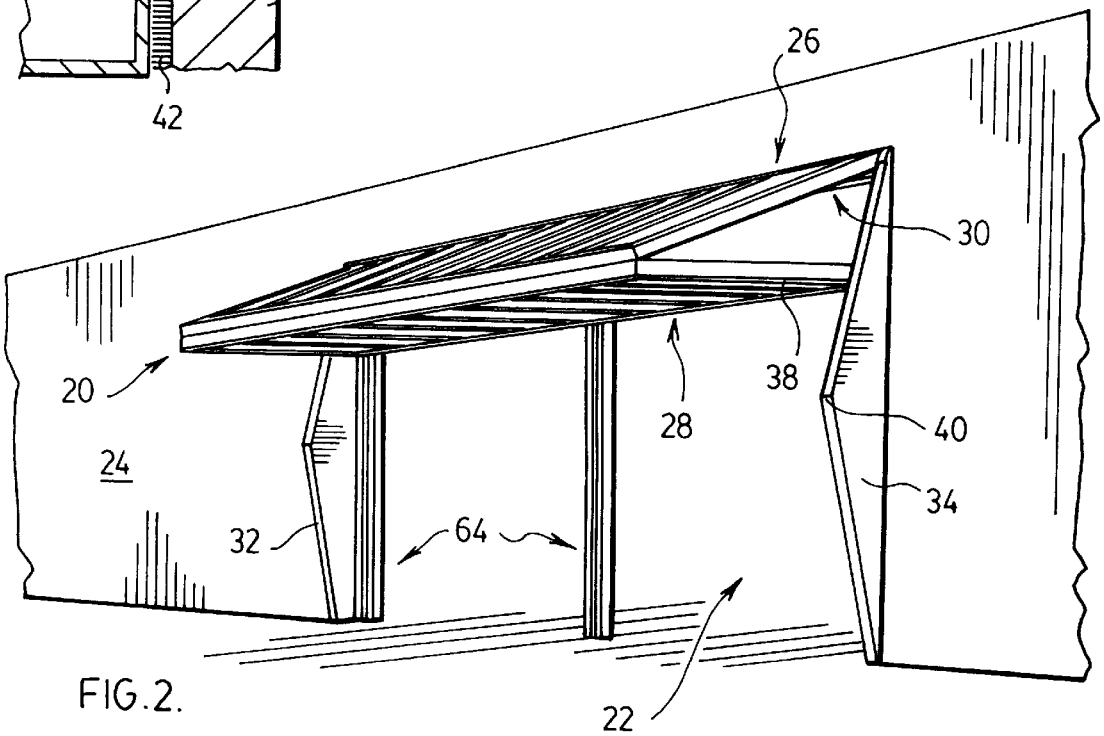

Referring first to FIGS. 1 and 2, a folding curtain wall structure in accordance with the invention is generally denoted by reference numeral 20 and is shown installed in an opening 22 in a fixed wall 24, for example, an external wall of a greenhouse at a garden centre. In this embodiment, the structure 20 acts as a door in wall 24.

Door 20 comprises upper and lower bi-fold panels 26, 28 respectively which are hinged together for folding about a first horizontal axis X—X. The upper panel 26 is mounted on wall 24 adjacent a top edge 30 of opening 22 for hinging about a second horizontal axis Y—Y parallel to the first horizontal axis.

Figure 4:
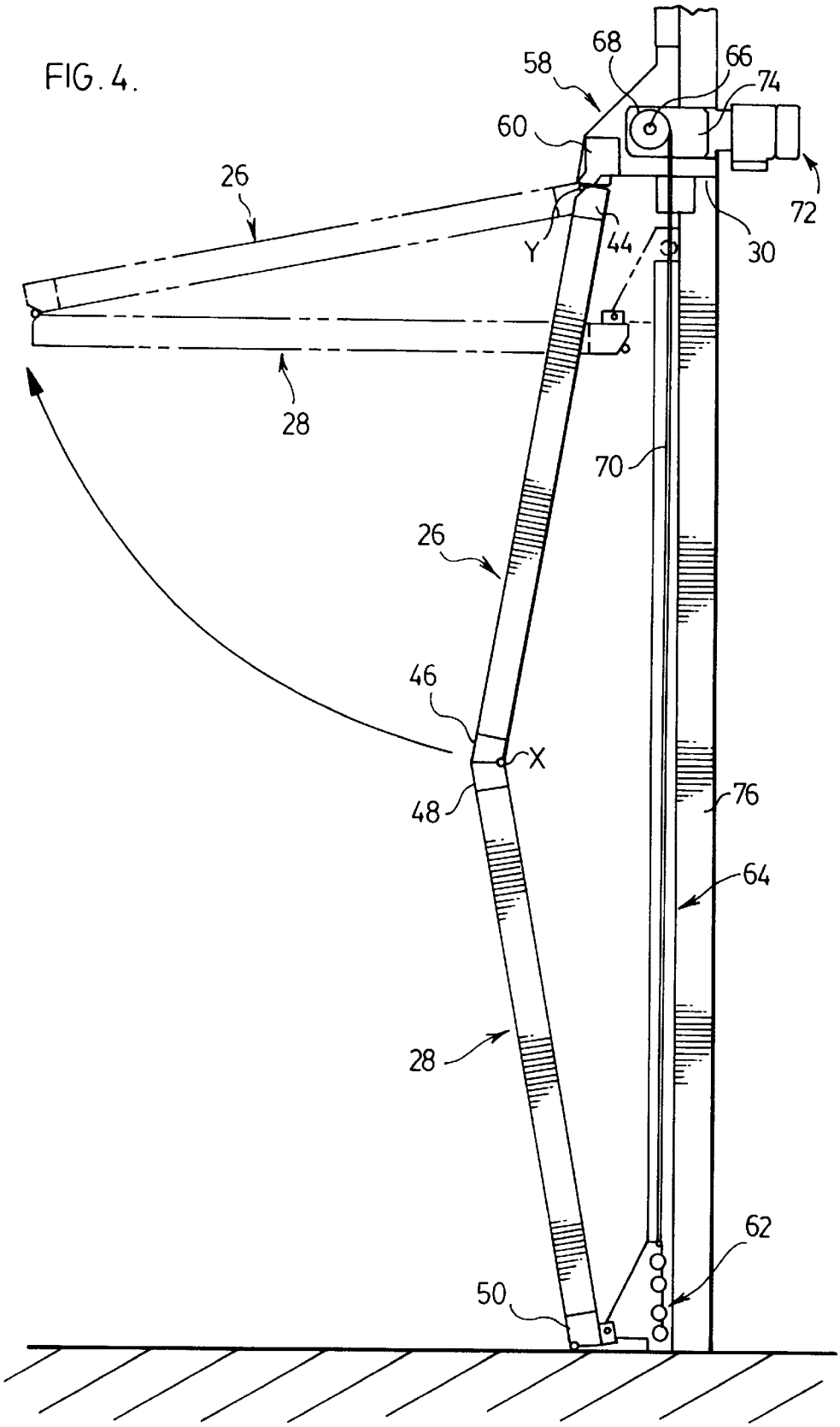
FIG. 4 is a schematic side elevational view showing the door in full lines in its closed position, and in phantom lines in an open position.
Figure 5:
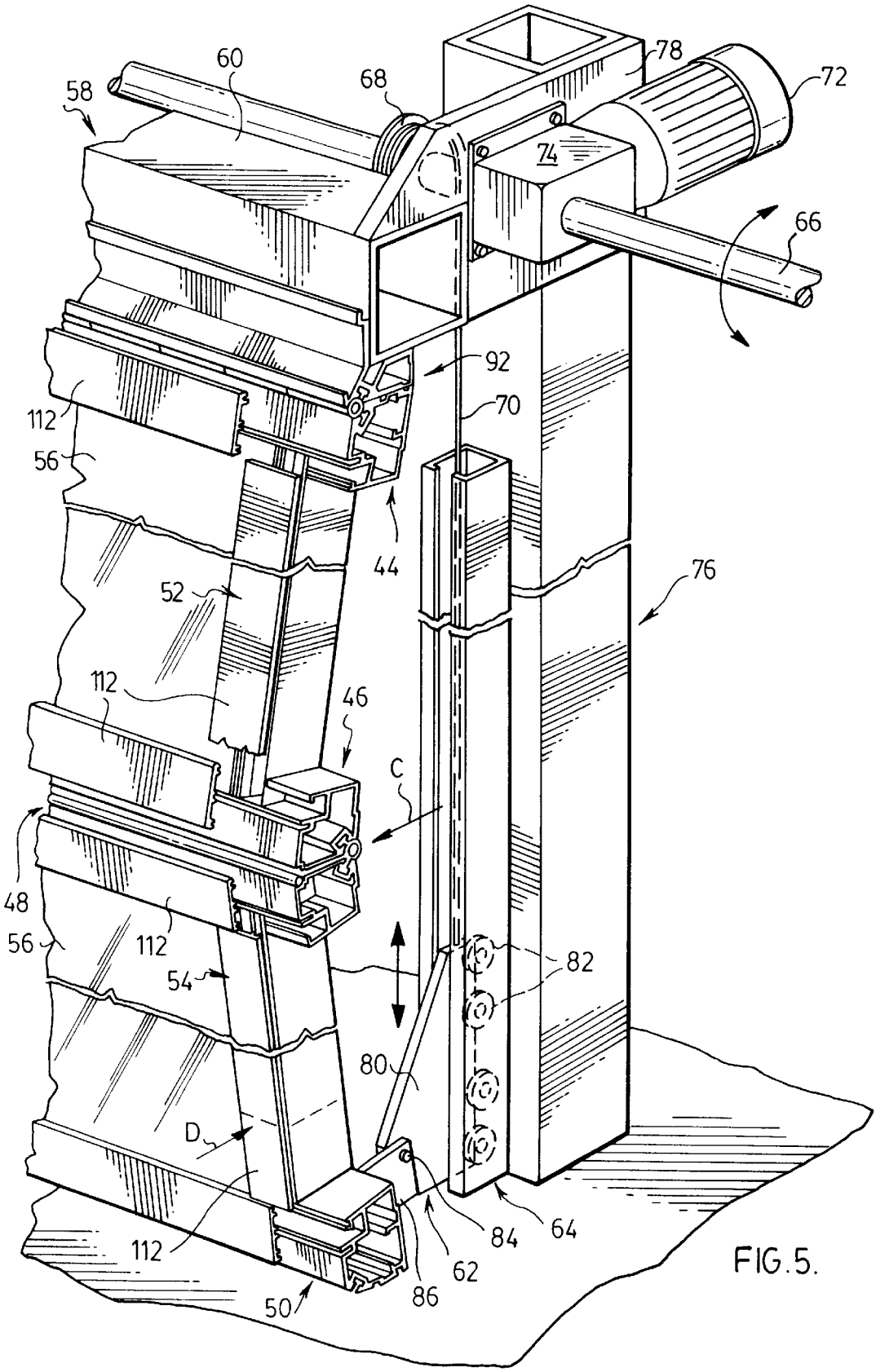
FIG. 5 is a vertical sectional view generally on the line denoted B—B in FIG. 1.
Figure 9:
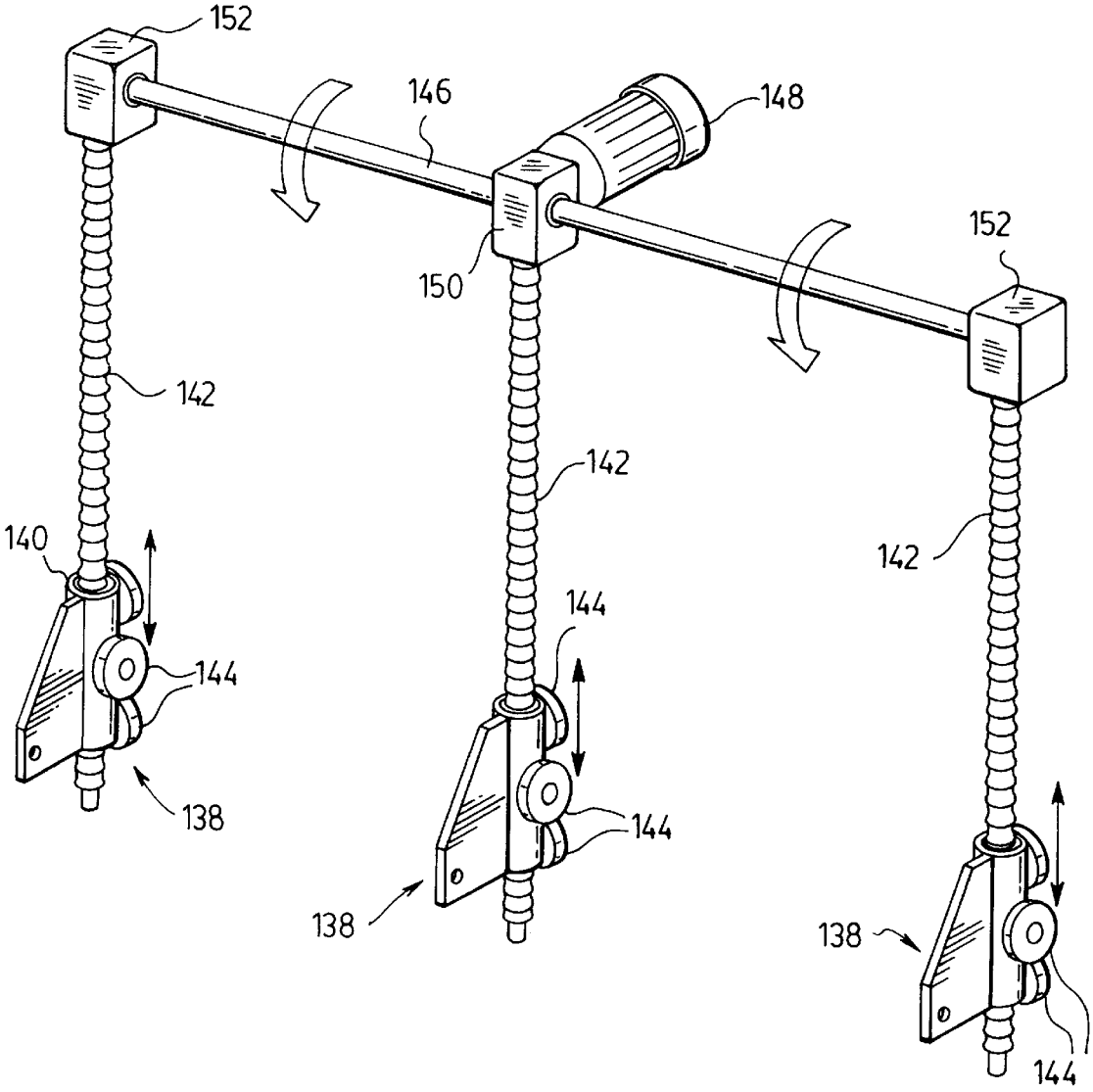
FIG. 9 is a schematic perspective view illustrating an alternative means for opening and closing the door; and, FIG. 10 is a view similar to FIG. 4 showing a version of the door which is flat when closed.

The panels can be moved between the closed position of FIG. 1 and the open position of FIG. 2 using a cable-lifting arrangement as shown in FIGS. 4 and 5, or a screw arrangement as shown in FIG. 9 (to be described). In the open position of FIG. 2, the panels are folded against one another and extend generally horizontally outwardly from the outer side of wall 24 generally at the location at the top edge 30 of opening 22. In this position, the panels provide an awning or shade. Particularly in an environment such as a garden centre, an awning of this form can be very useful in terms of providing protection for people entering or leaving the building and/or additional covered space outside the building.

While the size of opening 22, and hence the size of the panels 26 and 28 can vary substantially within the scope of the invention, the opening will be of sufficient height that the awning provided by the folded panels in the open position is at a height well above the heads of people who would be entering or leaving the building. For example, in a garden centre greenhouse, the awning may be an a minimum height of, say 8 to 10 feet above ground level in the open position and the opening 22 may have an overall height of, say, 11 to 14 feet. The length of the opening (and hence the length of the panels) is also widely variable. The maximum length is to some extent limited by the capacity of the lifting mechanism used to open and close the door but may range up to say, 70 feet or more.

In the closed position shown in FIGS. 1 and in full lines in FIG. 4, the two panels 26 and 28 adopt a configuration in which the panels are angled outwardly with respect to one another about the first axis X—X. This configuration ensures that the panels will fold easily when the door is to be opened, without the need to mechanically push out or pull in parts of the door to ensure proper folding. At the same time, in the closed position, the angled configuration ensures that the door has good resistance to wind loads. Referring to FIG. 1, the angle $\alpha$ defined between the vertical and the each panel 26, 28 in the closed position may be of the order of 10°.

Figure 1A:
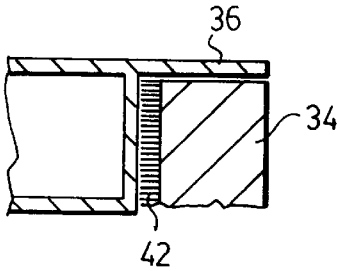
FIG. 1*a* is a sectional view on line A—A of FIG. 1.

To close generally triangular spaces that would otherwise be present at opposite sides of the door in the closed position, fixed side panels 32 and 34 extend outwardly from the wall 24 at opposite sides of opening 22. The door panels 26, 28 are sized to fit closely between the fixed panels 32 and 34. As shown in FIG. 1*a*, the side edges of the panels 26, 28 at opposite sides of the door are provided with flanges such as the flange 36 that overlie the fixed side panels 32 and 34 when the door is closed to provide a weather seal. Flange 36 (and a corresponding flange at the opposite side of the door) terminates short of the bottom edge of the lower panel 28, for example at the point indicated at 38 in FIG. 2, so that the flange clears the "peak" 40 of the side panel as the door opens and closes. Inwardly facing brushes such as the brush indicated at 42 in FIG. 1*a* are provided on the two fixed side panels 32 and 34 to co-operate with the bi-fold panels as the door opens and closes. It has been found in practice that these brushes, coupled with the flanges such as flange 36, provide for good weather and dirt sealing at the sides of the door.

Figure 3:
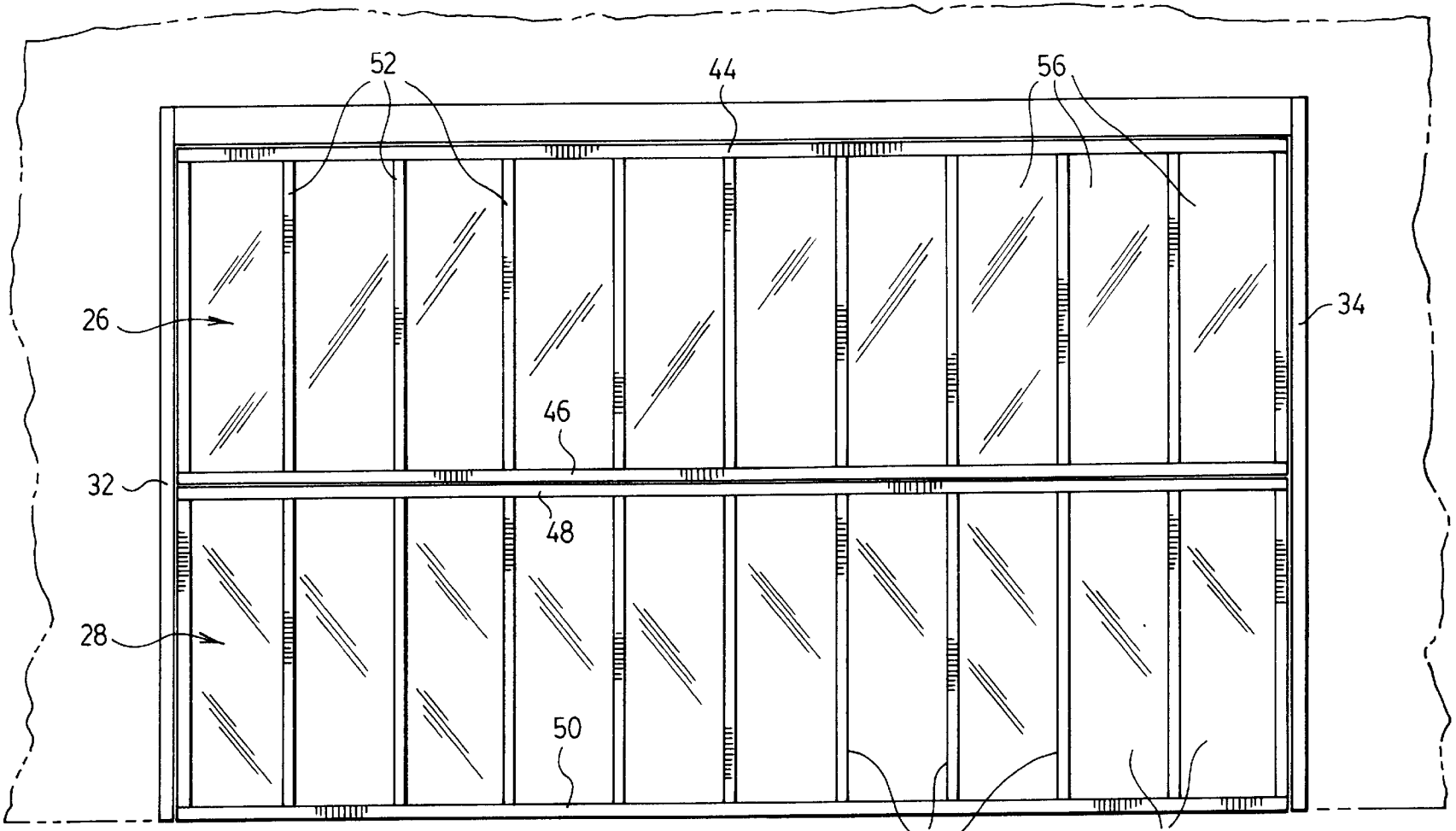
FIG. 3 is a front elevational view corresponding to FIG. 1.

FIG. 3 is an elevational view of the door in its closed position. It can be seen that each of the door panels 26 and 28 comprises a frame made up of upper and lower horizontal frame members (denoted 44 and 46 in the case of panel 26 and 48 and 50 in the case of panel 28), and vertical frame members 52 and 54 respectively that extend between the horizontal frame members in positions that are spaced along those members so as to define rectangular openings for receiving panes of glass 56 or glazed thermal window units. A header member 58 extends across the top of the opening 22 in wall 24 between the fixed side panels 32 and 34.

Accordingly, in this embodiment, the door has an appearance similar to that of a greenhouse wall, which means that it fits in well aesthetically with the remainder of the greenhouse. In other applications, the panels 26, 28 could of course be constructed differently to fit in with the overall design of the building.

FIG. 4 is a schematic side elevational view showing the door in full lines in its closed position and in phantom lines in the open position.

The header member 58 of FIG. 3 is also visible in FIG. 4 and is shown to include a box section member 60 from which the door panels are suspended. Thus, member 60 co-operates with the top frame member 44 of panel 26 to define the second horizontal axis Y—Y about which the door is pivoted. The bottom horizontal member 46 of the upper panel cooperates with the top horizontal member 48 of the lower panel 28 to define the first horizontal axis X—X.

The precise cross-sectional configurations of the various frame members are shown in detail in FIGS. 5 and 6, which will be described later.

For the present, it is to be noted that FIG. 4 also shows that the bottom marginal portion of the lower door panel 28 is provided with a series of wheeled carriages, one of which is indicated at 62. Each carriage runs in its own vertical track 64 so that the bottom marginal portion of panel 28 is guided to move in a vertical plane parallel to or containing the building wall 24 as the door moves between its open and closed positions.

The number of vertical tracks 64 and associated carriages 62 will depend on the width of the door, i.e. the horizontal extent of the opening 22. Carriages and tracks will be provided at least at opposite side edges of the door, but possibly at intervals spaced along the width of the door. By way of example, FIG. 2 shows one of the tracks 64 at the left-hand side of the door, and a similar track 64 at the centre of the width of the door. A third track will be provided at the right-hand side edge of the door but is hidden in FIG. 2. The tracks 64 and carriages 62 are essentially identical, and therefore only one of them has been shown in detail.

Referring back to FIG. 4, it will be seen that a shaft 66 extends horizontally within door header member 58 and is provided with a series of cable drums 68, one for each of the vertical tracks 68. A cable 70 is wound onto drum 68 and extends downwardly through the track 68 to the carriage 62. The cable is fixed to the carriage so that, by turning shaft 66 in the counterclockwise direction as shown in FIG. 4, carriage 62, as well as the other carriages across the width of the door, will be pulled up in the respective tracks 68 until the door reaches the open position shown in phantom lines.

Shaft 66 is driven in rotation by an electric drive motor 72 through a gearbox 74. Motor 72 is reversible for opening or closing the door, though the door will close under gravity by its own weight in this embodiment. Gearbox 74 is a self-locking box that will hold the door stationary in the event of a power failure.

Appropriate control equipment is provided for operating motor 72, including limit switches corresponding to the open and closed positions of the door, for stopping the motor when the door reaches either of those positions. The control equipment is essentially conventional and does not form part of the invention; accordingly, it has not been specifically shown or described.

Figure 6:
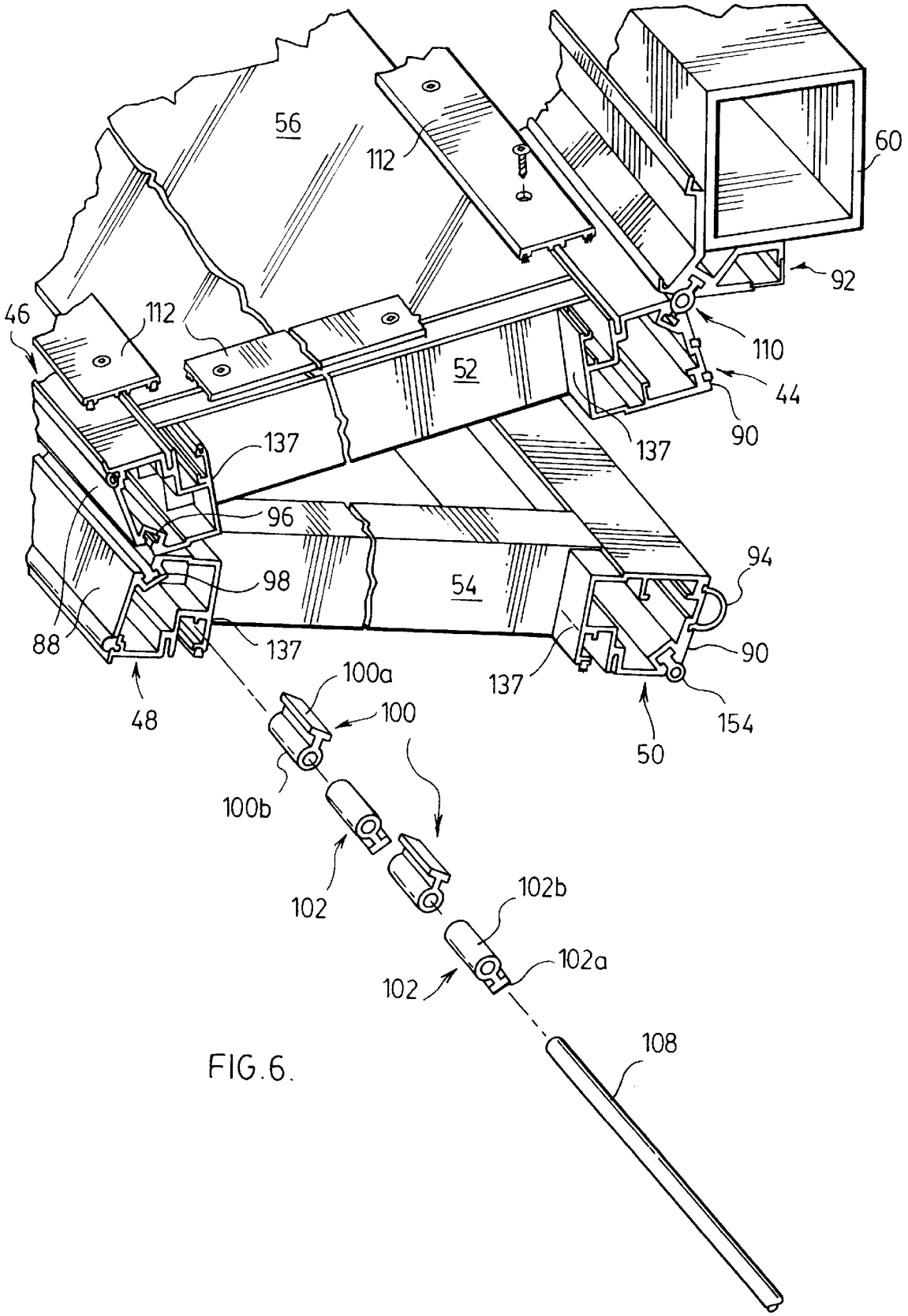
FIG. 6 is a perspective view in somewhat more detail, generally in the direction of arrow "C" in FIG. 5.

FIG. 5 shows the cable lifting arrangement in somewhat more detail, and FIGS. 5 and 6 together show the cross-sectional shapes of the various horizontal members of the door panel frames.

Referring first to FIG. 5, it will be seen that, in this embodiment, the door carriage track 64 is secured to the outer face of a main support column 76 of the building in which the door is installed.

The other similar tracks (not shown) also co-incide with main support columns. It is to be understood that, in other embodiments, the tracks themselves could be structural members, for example, supporting the door header 58. Support columns as column 76 also carry forwardly extending brackets, one of which is shown at 78, that support the gearbox 74 and bearings for the cable drum drive shaft 66. Further, bracket 78 (and its companions) carry the box section member 60 of the door header 58. For ease of illustration, FIG. 5 does not show panels that enclose member 60 and the cable drive and provide weather protection.

Track 64 is simply a box section member with a slot in its outer face and is bolted to column 76. Carriage 62 comprises a generally triangular plate 80 that extends through the slot in track 64 and is provided, within the track with a series of idler wheels 82 (on both sides of plate 80) that run inside the track 64. Externally of track 64, plate 62 is coupled by a pivot pin 84 to a plate 86 that is bolted to the bottom frame member 50 of the lower panel 58.

Figure 7:
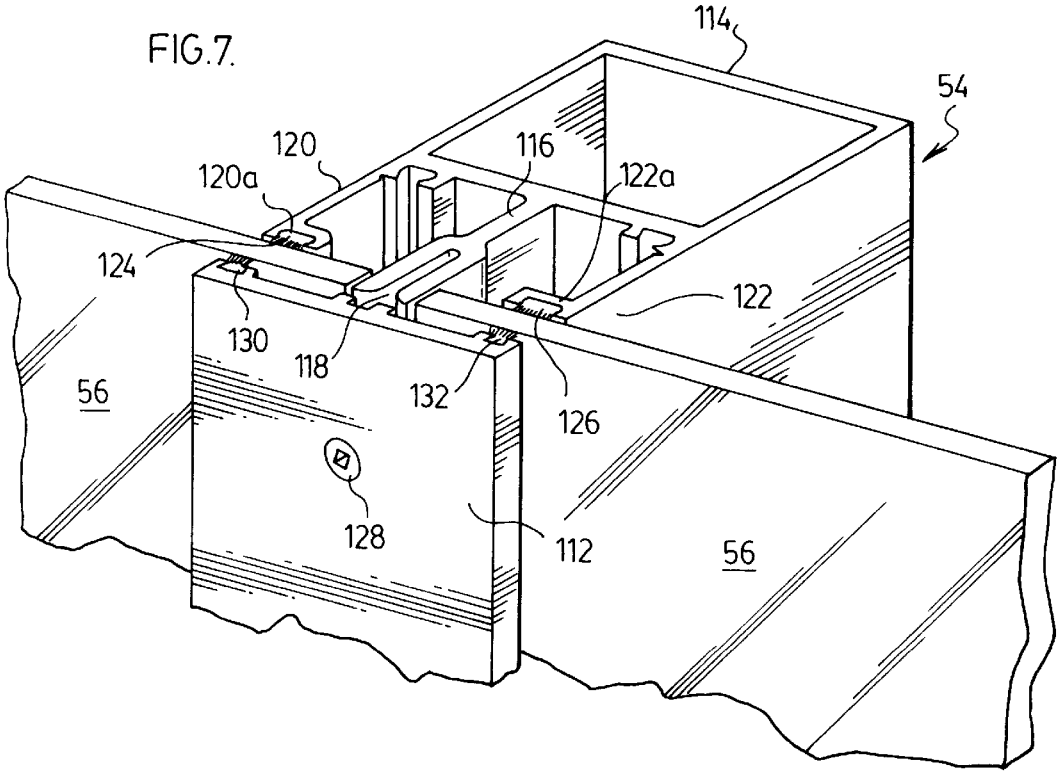
FIG. 7 is a perspective view generally in the direction of arrow "D" in FIG. 5, but showing a sectional view of a vertical frame member.
Figure 8:
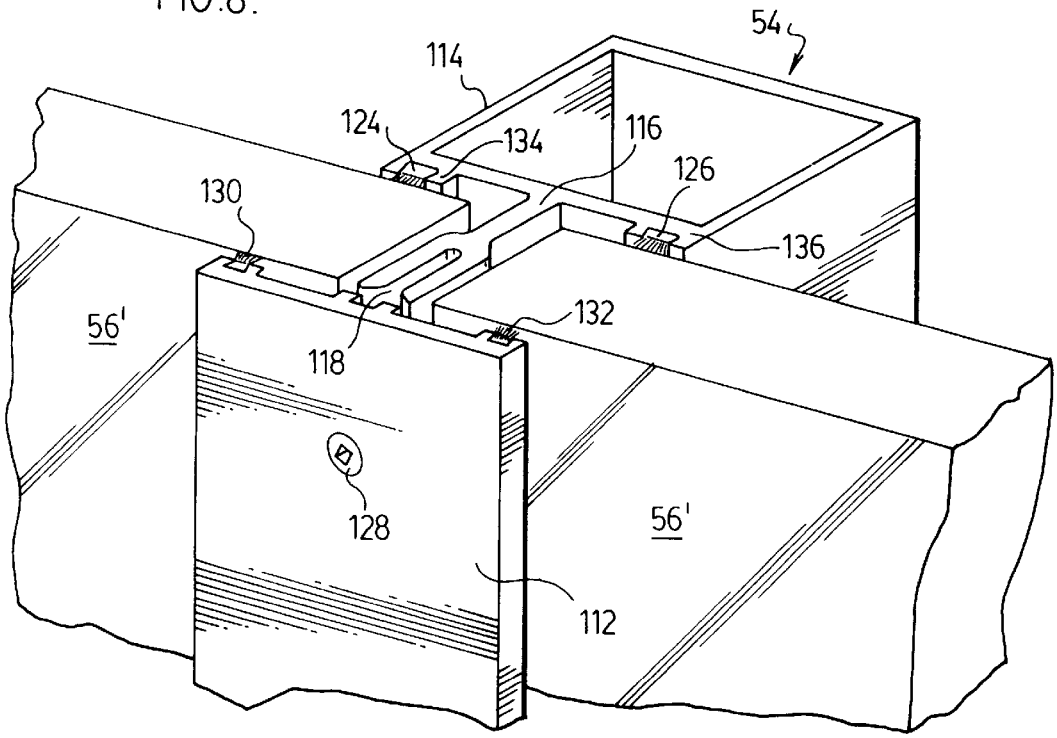
FIG. 8 is a view similar to FIG. 7 illustrating a modification.

FIGS. 5 and 6 show in some detail the cross-sectional shapes of the horizontal frame members 44 and 46 (of upper panel 26) and 58 and 50 (of lower panel 28). All of these members as well as the vertical frame members 52 are aluminum extrusions. The cross-sectional shape of the vertical frame members is shown in FIGS. 7 and 8, which will be described later. Joints between the horizontal and vertical frame members are formed by cutting a pair of vertical slots in a horizontal member (e.g. member 46 in FIG. 5) at the location of each joint, inserting the relevant vertical frame member 52 into the slots, and then rivetting the respective members together, essentially pursuant to normal greenhouse frame constructions techniques.

As can be seen most clearly from FIG. 6, the top frame member 44 of the upper panel 26 is made from the same extrusion as the bottom frame member 50 of lower panel 28. Also, the two extrusions 46 and 48 at the bottom of the upper panel and at the top of the lower panel respectively are the same. Generally, the extrusions are of box-section overall configuration, although not rectangular. The extrusion from which the member 46 is formed has an inclined face 88 that is angled to cooperate with the corresponding face 88 of member 48 when the door is in the closed position as shown in FIG. 5, to define the angled configuration of the two door panels. Similarly, the extrusion from which the members 44 and 50 are formed has an angled face 90. When the door is closed, the face 90 on member 44 abuts against the bottom face of box-section member 60, through an intermediate angle section member 92, to define the inclination of the top panel with respect to the vertical. The corresponding face 90 at the bottom of frame member 50 then lies substantially parallel with the ground surface when the door is closed. As best seen in FIG. 6, face 90 has slots that receive a weather seal 94 at the bottom of the door. The corresponding slots in the face 90 of member 44 are not used.

Referring back to frame members 46 and 48, it will be seen that respective slots 96 and 98 of undercut T-configuration extend longitudinally of the respective members, opposite to one another. Those slots slidingly receive complimentary T-formations 100*a*, 102*a* on respective hinge members 100 and 102. Externally of the formations, the members include, respective sleeves 100*b*, 102*b* which can be aligned to receive a hinge pin 108, for forming a hinge between the two panels 46 and 48 defining the "first" horizontal axis X—X. The hinge members 100, 102 are identical aluminum extrusions typically about 6" in length. Hinge pin 108 is a stainless steel rod. Usually, a continuous series of hinge members will be used end-to-end and will be alternately engaged with the respective frame members 46, 48.

It will be appreciated that this method of forming the hinge achieves the functional effect of the continuous "piano"-type hinge along the length of the door panels 26 and 28. The hinge effectively is assembled by slipping individual hinge members 100, 102 into the slots in the extrusions and progressively inserting the rod. This is a much simpler exercise than would be involved to install a conventional piano-type hinge.

Essentially the same hinge arrangement is used between the top horizontal frame member 44 of the upper panel 26 and the angle section member 92, as is indicated at 110 in FIG. 6. Member 92 is also an aluminum extrusion and is designed to provide the slot that is required to accommodate the relevant hinge elements 100 or 102. Member 92 is bolted to member 60 (bolts not shown).

FIGS. 5 and 6 also show pressure caps 112 that can be secured by self-tapping screws to the respective extrusions forming the frames for the door panels, after the panels have been assembled—for assuring weather-tight seals.

FIG. 7 shows the cross-sectional shape of the vertical frame members 52 of the panels 26 and 28. Each of the frame members is identical and is formed from the same aluminum extrusion, the crosssectional shape of which is shown in FIG. 7. It will be seen that the extrusion has a main rectangular section 114 from one face of which extend laterally, a central limb 116 having a slotted outer end portion 118, and a pair of side limbs 120, 122, having respective channel-shape formations 120*a* and 122*a* at their outer ends. These formations receive resilient sealing elements 124, 126 respectively for sealing against a pair of panes of glass oriented at right angles to the limbs 116, 120 and 122 and butted up to the centre limb 116. A pressure cap 112 is then secured across the opposing edges of the two panes of glass, by driving a series of self-tapping screws, one of which is indicated at 128, into the slot 118 in extrusion limb 116. The inner face of cap 112 is formed with channels for receiving sealing strips 130, 132 generally similar to the strips 124, 126. Thus, the two panes of glass are effectively secured within the frame of the door panel in weather-tight fashion. Further, the panes of glass can easily be replaced by simply removing the appropriate pressure caps 112.

Since only one pane of glass would be present if frame member 52 were at an end of the relevant door panel, a modified form of the extrusion is used there, and has a closed outer side with a flange comprising the flange 36 of FIG. 1*a*.

FIG. 8 illustrates the fact that the extrusion comprising member 52 can readily be modified to accommodate much thicker panels than the window panes 56 of FIG. 7. In FIG. 8, a pair of insulated glazed window units 56' are shown installed in place of the thin panes 56 of FIG. 7. The side limbs 120 and 122 of the extrusion shown in FIG. 7 are designed to break away back almost to the main box section 114, so that the extrusion has the shape shown in FIG. 8.

Channels 134, 136 formed on the main box section extrusion 114 are then exposed as shown in FIG. 8 and can receive the sealing elements 124, 126 previously referred to in connection with FIG. 7. Similarly, corresponding limbs on the longitudinal frame members can be broken away as indicated at break lines denoted 137 in FIG. 7.

FIG. 9 schematically illustrates an alternative form of mechanism for opening and closing the door that may be used in place of the cable and drum arrangement described previously. As shown in FIG. 9, the lower door panel is fitted with (in this case) three carriages 138 that replace the carriages 62 of the previous embodiment. The carriages 138 are also pivotally coupled to the bottom door frame member. However, instead of being lifted by cables, the carriages 138 incorporate internally screw-threaded sleeves 140, each of which receives a vertical screw-threaded rod 142. Idler wheels 144 are provided on each carriage 138 and each carriage runs in a track (not shown) that is essentially the same as the track 64 referred to previously. Rod 142 is supposed in bearings (not shown) to turn within the track, in essentially the same position as the cables referred to previously. At their upper ends, the rods are rotated from a horizontal shaft 146 driven by a motor 148 through respective gearboxes 150, 152. Again, the number of vertical rods 142 and hence the number of gearboxes will be dependent on the overall width of the door and may vary.

In any event, motor 148 turns the rod 146 as indicated by the arrows in FIG. 9 which in turn causes the vertical rods 142 to rotate in the appropriate direction. Since the carriages 138 cannot turn, they are drawn along the respective rods 142, either up or down depending on the direction of rotation of the rods. Again, motor 148 is reversible and the rods 142 all turn in the same direction, for causing the carriages 138 to all move up or all move down the respective rods 142, opening or closing the door.

The drive arrangement of FIG. 9, while more complex and expensive than the cable arrangement described previously offers advantages in terms of safety and security. The door is always positively driven in both directions and the door will always "fail safe". In other words, a malfunction or failure of a component of the mechanism can never cause the door to drop.

Figure 10:
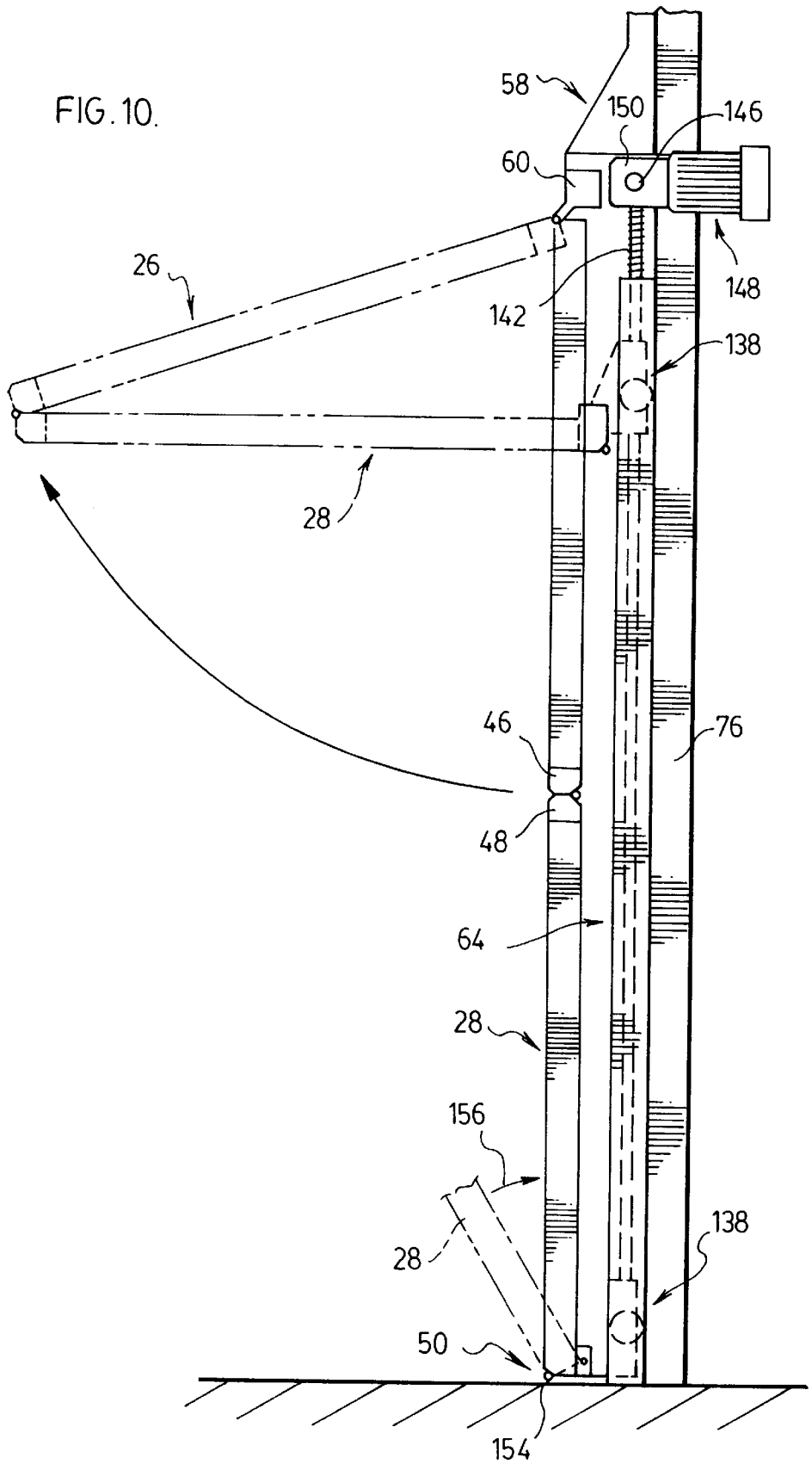

FIG. 10 illustrates an embodiment of the invention in which the door panels adopt a flat configuration when the door is closed. This configuration may be preferred when the curtain wall of the invention is used on an internal wall in the building, in which case wind loads on the curtain wall are not a consideration. FIG. 10 itself is generally similar to FIG. 4 except for the configuration of the door panels in the closed position. Also, it is important that the means for opening and closing the door drive the panels positively in both directions. In other words, the drive arrangement of FIG. 9, or an equivalent drive arrangement should be used.

Accordingly, the reference numerals used in FIG. 10 are the same as those used in FIG. 9 for the drive arrangement and in FIG. 4 for the door structure itself.

In terms of opening and closing of the door, it is important that the extrusion 50 at the bottom of the lower door panel 28 be provided at its bottom outer corner with a projection such as the cylindrical projection indicated at 154 in FIG. 10. This projection can be an extrusion in the form of one of the hinge elements 100 or 102 of FIG. 6 inserted into the undercut T-shaped slot at the bottom outer corner of extrusion 50, as indicated at 154 in FIG. 6. Alternative forms of projection, such as a pair of wheels at opposite sides of the lower door panel could be used instead.

As the door closes, the projection 154 is the first part of the bottom frame member 50 to contact the ground. At this time, the bi-fold panels 26 and 28 will be in a slightly angled configuration; the angled configuration of the lower panel is indicated, in a somewhat exaggerated form, in ghost outline in FIG. 10. As the carriage 138 of the drive arrangement continues to move down, the lower panel will tend to pivot on projection 154 in the clockwise direction as indicated by arrow 156, so that the two panels will be forced into a truly flat configuration. Conversely, when the door is to be opened and the carriage moves up, the lower panel 28 will tend to pivot in the opposite direction about projection 158. This will ensure that the panels begin to fold and that the door opens properly.

While projection 154 may pivot on the normal ground surface in the vicinity of the door opening, if necessary, one or more striker plates may be provided, for example at opposite sides of the door opening, to provide surfaces on which the projection pivots.

In summary, the invention provides a door structure that is particularly suitable for closing relatively large openings in buildings such as greenhouses or garden centres. As compared with conventional accordion doors or sliding doors, there is no need to make special provisions to accommodate door panels at the sides of the opening when the door is open, and no need for any threshold or track at ground level. In the open position, the door provides an awning or cover that can be useful in terms of providing shelter to people entering or leaving the building, or covered exterior space adjacent the building.

The door can be designed in a wide range of sizes according to application, up to door widths of 70 feet or more. The door panels themselves can be designed in any appropriate fashion to fit in with the design of the building overall. The door may be retrofitted in an existing building.

While the preceding description has been given in the context of an exterior door for a garden centre, possible applications of the invention are much broader than this, and include applications in the retail field, hospitality buildings, institutional buildings, sports facilities and pool enclosures. The door may be used on an internal or external wall and broadly should be perceived as a folding curtain wall, as discussed previously.

The preceding description deals with particular preferred embodiments of the invention, though many modifications are possible within the broad scope of the invention. For example, other methods that could be used for opening and closing the door could rely, for example, on chains running on sprockets for lifting the door, on hydraulic cylinders. Other alternatives may be rack and pinion or worm drives.

We claim:

1. A folding curtain wall structure installed in an opening in a fixed wall of a building, the structure comprising: upper and lower bi-fold panels which are hinged to one another for folding about a first horizontal axis; means for mounting said upper panel on said fixed wall adjacent an upper end of said opening for hinging about a second horizontal axis parallel to the first horizontal axis; and means for moving the panels between an open position in which the panels are folded against one another and extend generally horizontally from an outer side of said fixed wall in an overhead location, and a closed position in which the panels extend across and substantially close the opening;

wherein each said bi-fold panel comprises a frame of transverse generally horizontal members, and generally vertical members extending between the horizontal members and defining rectangular spaces, each receiving a glazed window unit, whereby each panel has an appearance resembling a section of a greenhouse wall;

and wherein each said panel includes respective said transverse horizontal members defining top and bottom edges of the panel, each comprising an extrusion which has a generally box-shaped cross-section, the extrusions at a bottom edge of said upper panel and at a top edge of said lower panel being hinged together in comer regions of the extrusions to define said first horizontal axis, so that opposed faces of said extrusions abut one another when said panels are in said closed position, said opposed faces being angled with respect to remaining faces of the extrusion to define a configuration of the panels in said closed position in which the panels are angled outwardly with respect to one another about said first axis.

2. A structure as claimed in claim 1, wherein said fixed wall includes fixed side panels that co-operate with said bi-fold panels for closing spaces at respectively opposite sides of the structure resulting from said angled configuration of the bi-fold panels.

3. A structure as claimed in claim 2, wherein each of said bi-fold panels is disposed in a plane at 10° to a vertical plane when said panels are in said outwardly angled configuration in said closed position.

4. A structure as claimed in claim 3, wherein said fixed side panels of the wall of the building have a triangular configuration which matches said angled configuration of the bi-fold panels in said closed position.

5. A structure as claimed in claim 4, wherein said bi-fold panels extend between said fixed side panels, and are provided with laterally directed flanges that overlie outer edges of said fixed side panels in said closed position of the bi-fold panels, said flanges being relieved at a spacing from a bottom end of said lower panel sufficient to permit said flanges to clear said side panels as the bi-fold panels move between said open and closed positions.

6. A structure as claimed in claim 1, wherein said means for moving the panels between an open position and a closed position comprises guide means constraining a bottom marginal portion of the lower panel to move in a generally vertical plane parallel to or containing said fixed wall, and means for raising and lowering said bottom marginal portion of the lower door panel as constrained by said guide means.

7. A structure as claimed in claim 6, wherein said guide means comprises at least one track which extends generally vertically of said opening, and a carriage movable in said track and coupled to said bottom marginal portion of the lower door panel, said means for raising and lowering said marginal portion of the lower panel being adapted to cause vertical movement of said carriage in said track.

8. A structure as claimed in claim 7, comprising a plurality of said vertical tracks spaced laterally of the opening, and each receiving a carriage coupled to said bottom marginal portion of the lower door panel, wherein said means for raising and lowering said bottom marginal portion of the lower door panel comprises a generally horizontal shaft extending transversely of said opening adjacent said upper end thereof, in association with each said track, a cable drum carried by said shaft and aligned with said track, a cable wound on each said drum and extending downwardly along said frack and coupled to said carriage, and a drive motor for rotating said shaft to simultaneously wind said cables onto or from the respective drums to raise or lower the lower door panel.

9. A structure as claimed in claim 8, further comprising a self-locking gearbox between said drive motor and said shaft, for locking said shaft and door against movement, in the event of failure of said motor.

10. A structure as claimed in claim 7, further comprising a plurality of said tracks spaced laterally of said opening, and each provided with a said carriage coupled to said bottom marginal portion of said lower panel, wherein said means for raising and lowering said bottom marginal portion of the lower panel comprises, an externally screw-threaded rod extending generally vertically within each said track, each carriage including a complimentarily internally screw-threaded sleeve receiving said rod, whereby rotation of the rod will cause the sleeve to move vertically of the rod; and means for simultaneously rotating said plurality of rods in the same rotational direction to simultaneously move said carriages in the same vertical direction.

11. A structure as claimed in claim 10, wherein said means for rotating said rods comprises a drive shaft extending generally horizontally transversely of said opening adjacent said upper end thereof, said motor being adapted to rotate said shaft, and a gearbox between each said vertical rod and said shaft for rotating the rod in response to turning of the shaft.

12. A structure as claimed in claim 1, wherein said extrusions are hinged together by hinge means comprising undercut T-section slots in said corner regions of the respective extrusions, a plurality of hinge elements received in the slots of the respective extrusions and each comprising a T-shaped formation slidably received in the relevant slot, and a sleeve portion for co-operation with sleeve portions of the other hinge elements to define a continuous sleeve, and a hinge pin received in said continuous sleeve for pivotally coupling the hinge elements and the panels together.

13. A structure as claimed in claim 12, wherein said hinge elements are identical to one another and are alternately arranged in said slots in the respective extrusions.

14. A structure as claimed in claim 12, further comprising a header member extending transversely of an upper end of said opening and including an extrusion, wherein said extrusion and the extrusion defining said top edge of the upper panel are formed with respective undercut T-section slots receiving hinge elements and a hinge rod the same as the hinge elements and hinge rod defining said first horizontal axis, for defining said second horizontal axis.

15. A structure as claimed in claim 1, wherein said vertical frame members also comprise extrusions, and wherein said glazed window units are coupled to the horizontal and vertical extrusions by trim panels that are secured to the extrusions in spaces between adjacent window units, and wherein portions of the extrusions supporting said glazed window units comprise break-away limbs that can be removed so that a glazed window unit of a first thickness can be accommodated without removing the limbs, and glazed window units of greater thickness can be accommodated after the limbs have been removed.

16. For installation in an opening in a fixed wall of a building, a folding curtain wall structure comprising: upper and lower bi-fold panels adapted to be hinged to one another for folding about a first horizontal axis, said upper panel being adapted for mounting on said fixed wall adjacent an upper end of the opening for hinging about a second horizontal axis parallel to the first horizontal axis; and means for moving the panels between an open position in which the panels are folded against one another and extend generally horizontally from an outer side of said fixed wall in an overhead location, and a closed position in which the panels extend across and substantially close the opening;

wherein each said bi-fold panel comprises a frame of transverse generally horizontal members, and generally vertical members extending between the horizontal members and defining rectangular spaces, each receiving a glazed window unit, whereby each panel has an appearance resembling a section of a greenhouse wall;

and wherein each said panel includes respective said transverse horizontal members defining top and bottom edges of the panel, each comprising an extrusion which has a generally box-shaped cross-section, the extrusions at a bottom edge of said upper panel and at a top edge of said lower panel being hinged together in corner regions of the extrusions to define said first horizontal axis, so that opposed faces of said extrusions abut one another when said panels are in said closed position, said opposed faces being angled with respect to remaining faces of the extrusion to define a configuration of the panels in said closed position in which the panels are angled outwardly with respect to one another about said first axis.

17. A folding curtain wall structure installed in an opening in a fixed wall of a building, the structure comprising: upper and lower bi-fold panels which are hinged to one another for folding about a first horizontal axis; means for mounting said upper panel on said fixed wall adjacent an upper end of said opening for hinging about a second horizontal axis parallel to the first horizontal axis; and means for moving the panels between an open position in which the panels are folded against one another and extend generally horizontally from an outer side of said fixed wall in an overhead location, and a closed position in which the panels extend across and substantially close the opening;

and wherein each said panel includes respective transverse horizontal members defining top and bottom edges of the panel, each comprising an extrusion which has a generally box-shaped cross-section, the extrusions at a bottom edge of said upper panel and at a top edge of said lower panel being hinged together in corner regions of the extrusions to define said first horizontal axis, so that opposed faces of said extrusions abut one another when said panels are in said closed position, said opposed faces being angled with respect to remaining faces of the extrusion to define a configuration of the panels in said closed position in which the panels are angled outwardly with respect to one another about said first axis.

* * * * *